US010627103B2

(12) United States Patent
Lakhov et al.

(10) Patent No.: US 10,627,103 B2
(45) Date of Patent: Apr. 21, 2020

(54) STEAM GENERATOR

(71) Applicant: JOINT STOCK COMPANY "EXPERIMENTAL AND DESIGN ORGANIZATION"GIDROPRESS "AWARDED THE ORDER OF THE RED BANNER OF LABOUR AND CZSR ORDER OF LABOUR", Moskovskaya obl., Podolsk (RU)

(72) Inventors: Dmitriy Aleksandrovich Lakhov, Podolsk Moskovskaya olb. (RU); Andrey Alekseevich Gritsenko, Podolsk Moskovskaya olb. (RU)

(73) Assignee: Joint Stock Company "Experimental and Design Organization "Gidropress" Awarded the Order of the Red Banner of Labour and Czsr Order of Labour", Podolsk (RU)

( * ) Notice: Subject to any disclaimer, the term of this patent is extended or adjusted under 35 U.S.C. 154(b) by 0 days.

(21) Appl. No.: 15/740,718

(22) PCT Filed: Jun. 2, 2016

(86) PCT No.: PCT/RU2016/000333
§ 371 (c)(1),
(2) Date: Dec. 28, 2017

(87) PCT Pub. No.: WO2017/007371
PCT Pub. Date: Jan. 12, 2017

(65) Prior Publication Data

US 2018/0195712 A1 Jul. 12, 2018

(30) Foreign Application Priority Data

Jul. 7, 2015 (RU) ..... 2015126931

(51) Int. Cl.
*F28F 9/02* (2006.01)
*F22B 1/12* (2006.01)
(Continued)

(52) U.S. Cl.
CPC ..... *F22B 1/123* (2013.01); *F22B 1/02* (2013.01); *F22B 1/023* (2013.01); *F22B 1/10* (2013.01);
(Continued)

(58) Field of Classification Search
CPC ..... B22B 1/006; B22B 1/06; B22B 1/123; B22B 1/02; B22B 1/023; B22B 1/10;
(Continued)

(56) References Cited

U.S. PATENT DOCUMENTS 4,030,477 A * 6/1977 Smith ..... F24S 23/75 126/695
4,193,879 A * 3/1980 Leach ..... B01J 19/121 359/345

(Continued)

*Primary Examiner* — Davis D Hwu
(74) *Attorney, Agent, or Firm* — Brandon V. Zuniga; James R. Gourley; Carstens & Cahoon, LLP

(57) ABSTRACT

A steam generator that reduces the thermal and hydraulic unevenness in the steam generator, improves the filling capacity of the steam generator with heat exchange tubes, organizes an economizer portion of the heat exchange surface in the steam generator, and reduces the concentration of corrosive impurities in the weld zone of the primary circuit to the horizontal shell. To solve the task in such steam generator containing the horizontal shell and other component, the heat exchange tubes are located in vertical planes, and the inlet and outlet manifolds of the primary circuit are arranged horizontally. The steam generator can also be equipped with at least two output manifolds of the primary circuit furthers, the feed water dispenser can be located below the heat exchange tubes of the steam generator.

4 Claims, 4 Drawing Sheets

(51) Int. Cl.

| | |
|---|---|
| ***F22B 1/02*** | (2006.01) |
| ***F22B 37/22*** | (2006.01) |
| ***F22B 37/00*** | (2006.01) |
| ***F22B 1/10*** | (2006.01) |
| ***F22B 37/66*** | (2006.01) |
| ***F22B 37/68*** | (2006.01) |
| *F28D 1/02* | (2006.01) |

(52) U.S. Cl.
CPC ..... *F22B 37/002* (2013.01); *F22B 37/228* (2013.01); *F22B 37/66* (2013.01); *F22B 37/68* (2013.01); *F28D 1/0206* (2013.01)

(58) Field of Classification Search
CPC ..... B22B 37/002; B22B 37/228; B22B 37/66; B22B 37/68; B22B 1/0206; F24D 11/003; F24S 23/75; B01J 19/121
USPC ..... 165/158
See application file for complete search history.

(56) References Cited

U.S. PATENT DOCUMENTS

| | | | | |
|---|---|---|---|---|
| 4,244,350 | A * | 1/1981 | Chubb | F22B 1/06 126/400 |
| 2011/0126824 | A1* | 6/2011 | Conlon | F22B 1/006 126/601 |
| 2014/0190469 | A1* | 7/2014 | O'Donnell | F24D 11/003 126/714 |

* cited by examiner

STEAM GENERATOR

CROSS-REFERENCE TO RELATED APPLICATIONS

This application is a US 371 Application from PCT/RU2016/000333 filed Jun. 2, 2016, which claims priority to Russia Application 2015126931 filed Jul. 7, 2015, the technical disclosures of which are hereby incorporated herein by reference.

TECHNICAL FIELD

The invention relates to nuclear power engineering, and more particularly to steam generators of nuclear power plants.

BACKGROUND OF THE INVENTION

A steam generator is known comprising a horizontal body, an input manifold of the primary circuit, an outlet manifold of the primary circuit, heat exchange tubes, a feed water dispenser, a separation device made as a corrugated plates scrubber or steam receiving plate, a heat exchange tube support, and a submerged hole sheet. (Lukasevich B. I, Trunov N. B, Dragunov Yu. G., Davidenko S. E. Steam generators of VVER reactors for nuclear power plants.—M.: ICC Akademkniga, 2004 pp. 70-86). This steam generator is chosen as a prototype of the proposed solution.

INVENTION DISCLOSURE

This steam generator has design drawbacks, the first of which is that the steam generator features a high uneven distribution of the heat flux passing through the conditioned surface of the water level in the steam generator, called the evaporation mirror. This disadvantage leads to a significant difference in the generation of steam over the area of the evaporation mirror of the steam generator, and does not allow the creation of steam generators of the above construction, designed for high power energy conduction.

The second disadvantage of this SG is also related to the uneven generation of steam in the steam generator and consists in the fact that the volume of the steam generator provided for filling it with heat exchange tubes is not filled with them optimally, and, as a consequence, the specific weight dimension characteristics of the steam generator are also not optimal.

The third disadvantage of the steam generator is also related to the uneven generation of steam in the steam generator and consists in the fact that the feed water entering the steam generator through the feed water dispenser is supplied in the SG zones having a vapor content in an amount sufficient to heat the feed water intensively to the saturation temperature at the expense of condensation of steam. As a consequence, it is not possible in the steam generator to organize a section of the heat exchange surface with an increased temperature head and thereby reduce its metal capacity, or increase the pressure of the generated steam.

It is an object of the present invention to provide a steam generator that allows to provide heat dissipation of a large thermal power of the reactor, increase of reliability, reduction of specific weight dimension characteristics and improvement of technical and economic parameters of a steam generator in comparison with a current prototype.

The technical result of the proposed invention consists in reducing the thermal and hydraulic unevenness in the steam generator, improving the filling capacity of the steam generator with heat exchange tubes, organizing an economizer portion of the heat exchange surface in the steam generator, reducing the concentration of corrosive impurities in the weld zone of the primary circuit to the horizontal shell.

To solve the task in the steam generator containing the horizontal shell, the inlet and outlet manifolds of the primary circuit, the heat exchange tubes, the feed water dispenser, it is proposed to locate heat exchange tubes of the steam generator in vertical planes, and arrange the inlet and outlet manifolds of the primary circuit horizontally.

It is also proposed to equip the steam generator with more than one output manifold of the primary circuit, for example, two.

There is also an option, wherein the feed water dispenser is located below the heat exchange tubes of the steam generator.

BRIEF DESCRIPTION OF THE DRAWINGS

The essence of the claimed technical solution is explained in the drawings, where:

DETAILED DESCRIPTION OF THE PREFERRED EMBODIMENTS

Figure 1:
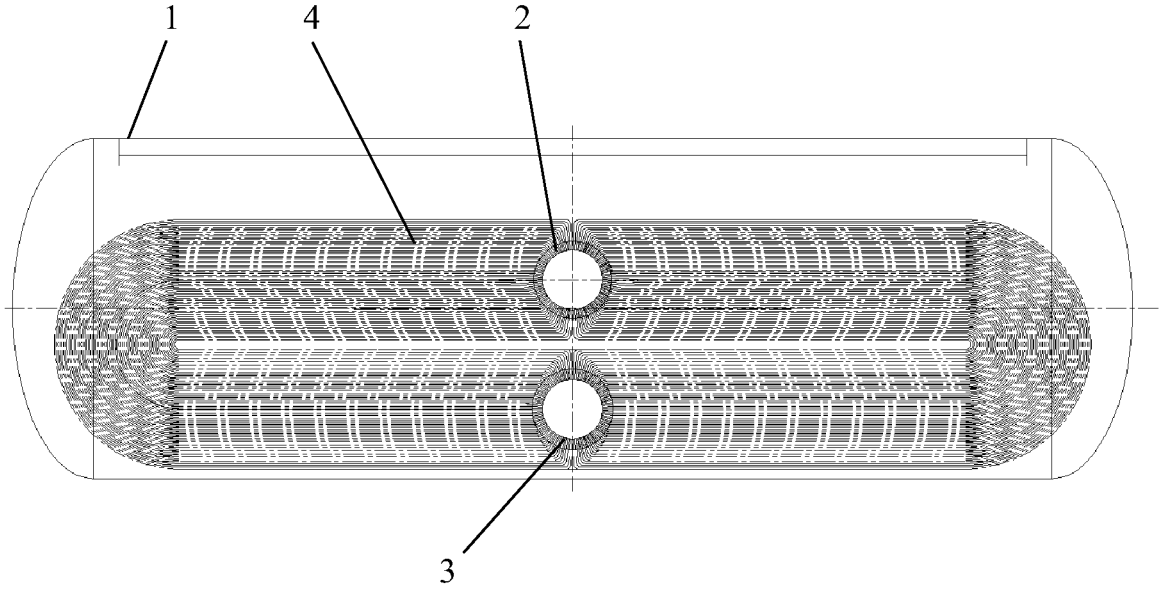
FIG. 1 shows a longitudinal section of a steam generator.
Figure 2:
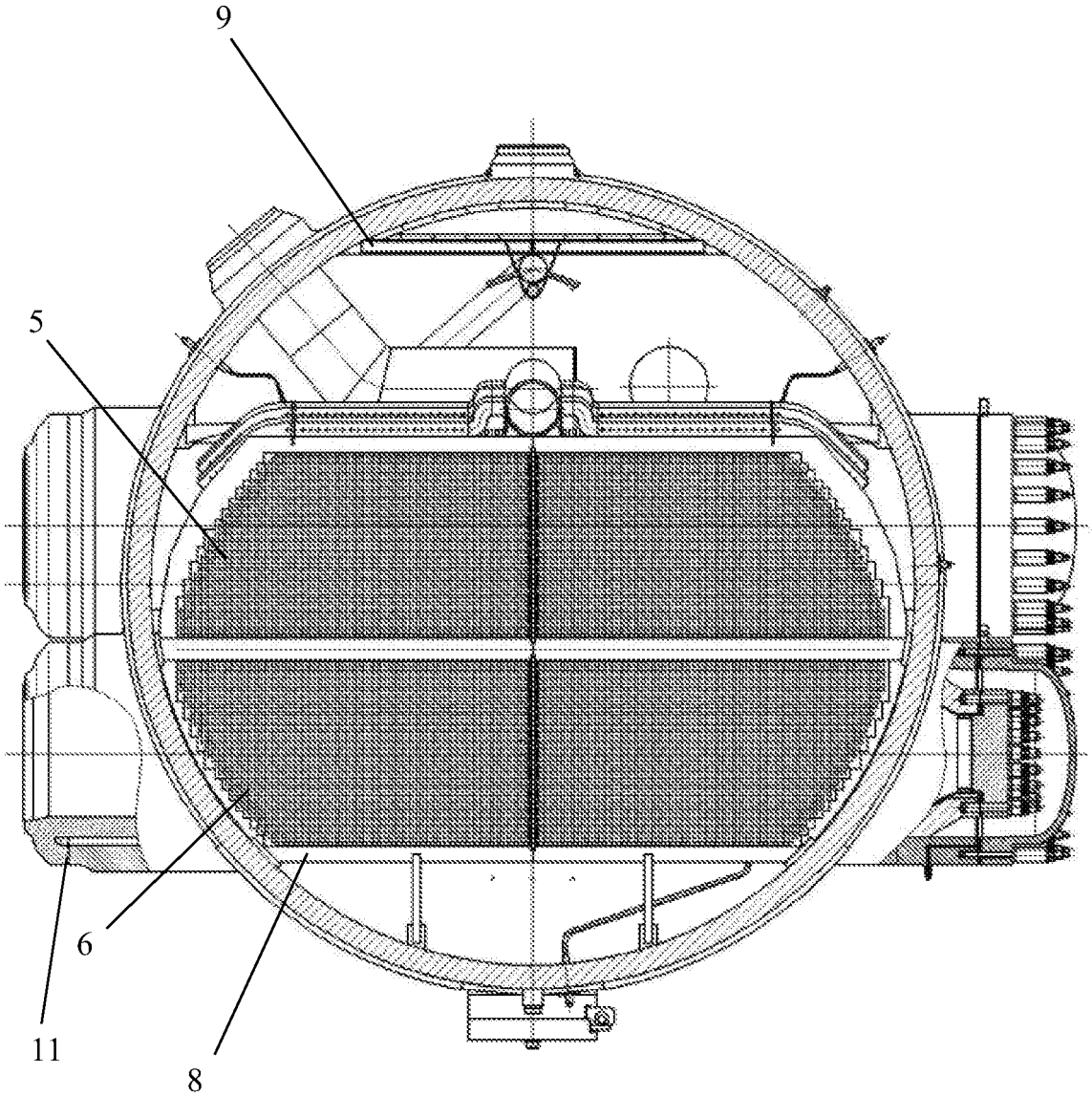
FIG. 2 shows a cross section of a steam generator.
Figure 3:
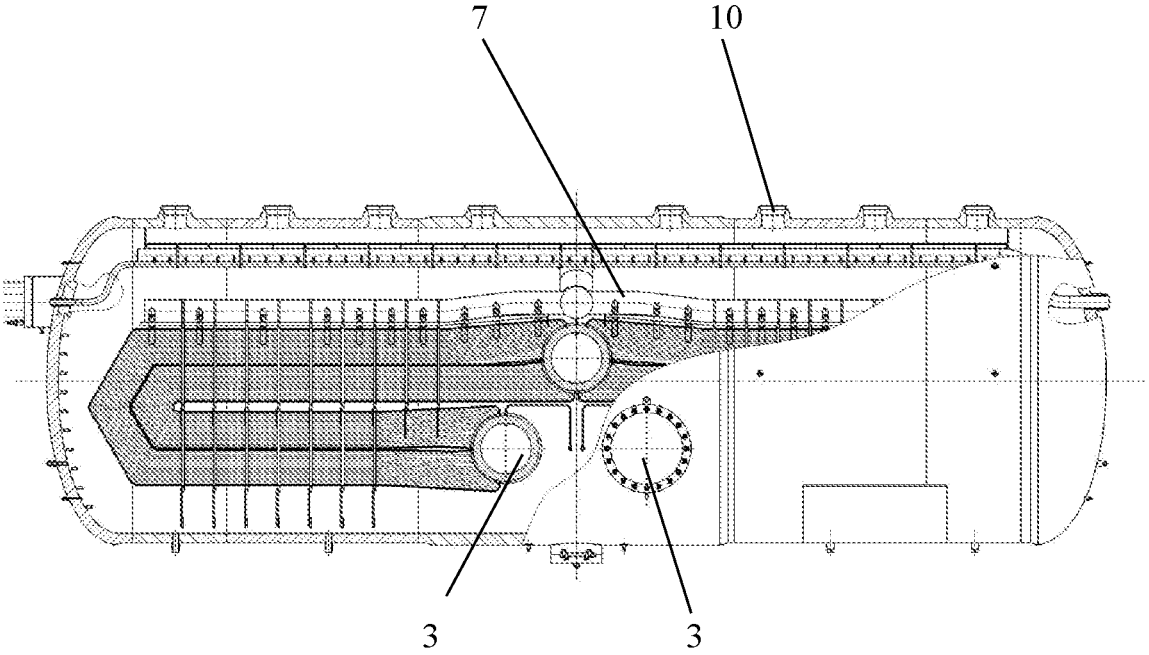
FIG. 3 shows a longitudinal section of the steam generator that has two output manifold of the primary circuit.

The steam generator is a single-shell heat exchanger of a horizontal type with a heat exchange surface immersed under the water level and comprises the following components shown in the attached figures: a horizontal shell 1, an inlet manifold 2 of a primary circuit, an outlet manifold 3 of a primary circuit (one or more), heat exchange tubes 4, which form the heat exchange surface of the steam generator mentioned above and are formed in the upper 5 and lower 6 stacks of heat exchange tubes 4, the feed water dispenser 7, which can be located both above and below the heat exchange tubes 4, the supporting device 8 of heat exchange tubes, one or more of evaporating pipes 9.

Figure 4:
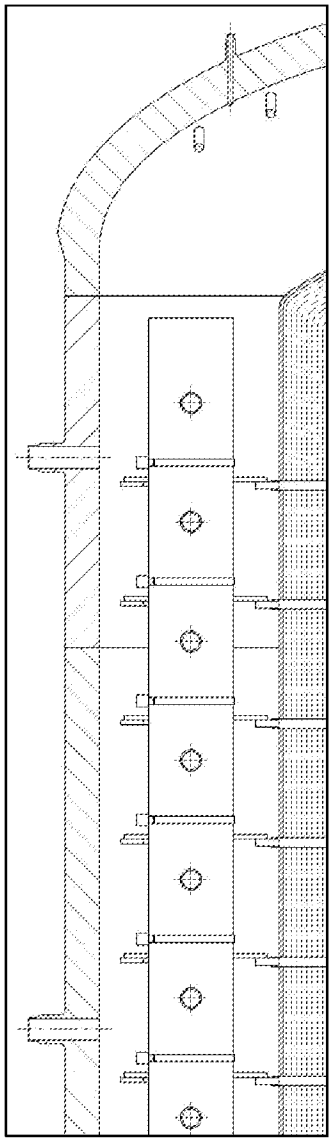
FIG. 4 shows distribution of feed water device located below the heat exchanger tubes.

The design of the steam generator is based on the following core principle of operation. The heat carrier (water) heated in the reactor is fed into the input 2 manifold of the primary circuit. From the inlet manifold 2 of the primary circuit, the heat carrier enters the heat exchange tubes 4 and moves along them, giving its heat through the wall of the heat exchange tubes 4 to the boiler water, and is collected in the outlet manifold 3 of the primary circuit (or several manifolds). From the outlet 3 of the primary circuit manifold, the heat carrier is returned to the reactor using a circulation pump (not shown in the drawing). The horizontal body 1 of the steam generator is filled with boiler water to a certain level, which is kept constant during operation. The feed water is fed to the steam generator through the dispenser 7 of the feed water. In the case where the feed water dispenser 7 is located above the heat exchange tubes 4, the feed water flows out of it and mixes with the boiler water and is heated to the saturation temperature, thereby condensing the excess amount of steam generated by the heat exchange surface of the steam generator. In the case where the feed water dispenser 7 is located below the heat exchange tubes 4, as shown in FIG. 4, the feed water flows out into the space between the heat exchange tubes 4 and warms up to the saturation temperature due to the heat emitted by the heat carrier.

The heat transferred from the heat carrier is used to evaporate boiler water and to form steam in the intertubular space of the steam generator. The resulting steam rises upwards and flows to the separation device of the steam generator, for example, to the steam receiving plate 9. Further, it is withdrawn from the steam generator through at least one evaporating pipe 10. The steam produced by the steam generator is used in the steam power process cycle of power generation.

The use of the horizontal arrangement of the inlet 2 and outlet 3 manifolds of the primary circuit and the placement of the heat exchange tubes 4 in the vertical planes makes it possible to reduce the number of heat exchange tubes 4 in the upper 5 and lower 6 stacks of the heat exchange tubes 4 vertically as compared to the current prototype. Wherein intensive vaporization is carried out only on the heat exchange surface of one of the stacks of pipes, either upper 5 or lower 6 one, since in a half of the heat exchange tubes 4, the hot heat carrier flows in the cross section of the steam generator, and in another half, the heat carrier flows that is already cooled due to the heat transfer to the boiler water. This pattern is observed in any cross section of the steam generator. From section to section, the ratio between the amount of steam generated in the upper 5 and lower 6 stacks of heat exchange tubes 4 varies. The total amount of steam generated in this cross section of the steam generator remains practically constant, regardless of where this section is made. Due to this, a technical result is achieved: a decrease in the thermal and hydraulic unevenness in the steam generator. As a consequence, when the steam generator is scaled and its heat exchange surface is increased, no zones with a high intensity of steam generation are formed in the steam generator, and this allows the design of a steam generator designed for a high power energy conduction. This also allows for the use of assemblies of heat exchange tubes 4 of more density in the design of the steam generator in comparison to the prototype, because due to the equalization of the generation of steam along the area of the evaporation mirror of the steam generator and the reduction of the number of hot heat exchange tubes 4 along the height of the upper stack 5, the local vapor content in the intertubular space of the steam generator also decreases. The denser arrangement of the heat exchange tubes 4 in the steam generator makes it possible to improve the filling capacity of the heat exchange tubes 4 and to reduce the specific weight dimension characteristics of the steam generator.

The use in the steam generator of at least two output 3 manifolds of the primary circuit allows to increase the number of pipelines feeding the heat carrier to the reactor, and the pumps that deliver the heat carrier from the steam generator to the reactor. This reduces somewhat the specific weight characteristics of the proposed steam generator, but simplifies the technology of its assembly, reduces the required capacity of pumps for transferring the heat carrier from the steam generator to the reactor, helps to reduce the thermal hydraulic unevenness in the reactor due to a more uniform supply of heat carrier along its circumference and increased reliability.

The arrangement of the dispenser 7 of feed water below the heat exchange tubes 4 of the steam generator allows the cold feed water to be supplied directly to the heat exchange surface of the steam generator without heating it to saturation by condensing the generated steam. This ensures a lowering of the temperature in the intertubular space of the lower stack 6 of the heat exchange tubes 4 of the steam generator. As a consequence, a heat exchange area is formed in the steam generator, where the temperature head is increased and the heat exchange surface required for heat transfer is reduced. This allows either to reduce the metal capacity of the steam generator by reducing its heat exchange surface and reducing the dimensions of the steam generator, or to raise the pressure of the produced steam, while maintaining the value of the heat exchange surface. Both results ultimately contribute to improving the technical and economic performance of the steam generator.

Due to the horizontal arrangement of the inlet 2 and outlet 3 manifolds of the primary circuit, the welded seams 11 of the primary circuit manifolds welded to the horizontal shell 1 can be transferred from the lower part of the horizontal shell 1 where the sludge is accumulated during operation to its side part. This leads to a decrease in the concentration of corrosive impurities near the aforementioned welded seams, reducing the probability of their corrosion damage, and improving the reliability of the steam generator.

The invention claimed is:

1. A steam generator configured to generate steam from feed water by heating the feed water with heat carrier water, the steam generator comprising (i) a horizontal shell configured to at least partly house the feed water while it is vaporized to generate the steam; (ii) an inlet manifold and an outlet manifold of a primary circuit for the heat carrier water; (iii) heat exchange tubes configured to receive at least some of the heat carrier water from the inlet manifold, transfer heat from the heat carrier water to the feed water to generate steam, and discharge at least some of the heat carrier water to the outlet manifold; and (iv) a feed water dispenser configured to dispense the feed water into the horizontal shell; characterized in that the heat exchange tubes of the steam generator are arranged in vertical planes, and the inlet and outlet manifolds of the primary circuit are horizontally disposed.

2. The steam generator according to claim 1, wherein the steam generator is provided with at least two outlet manifolds of the primary circuit.

3. The steam generator according to claim 1, characterized in that the feed water dispenser is located below the heat exchange tubes of the steam generator.

4. The steam generator according to claim 2, characterized in that the feed water dispenser is located below the heat exchange tubes of the steam generator.

* * * * *